US008821063B2

(12) United States Patent
Johnson et al.

(10) Patent No.: US 8,821,063 B2
(45) Date of Patent: Sep. 2, 2014

(54) CONTROL SYSTEM AND METHOD FOR ROAD CUTTING MACHINE

(75) Inventors: H. Matthew Johnson, Shermansdale, PA (US); Jeffreu M. Dows, Mechanicsburg, PA (US)

(73) Assignee: Surface Preparation Technologies, LLC, Mechanicsburg, PA (US)

( * ) Notice: Subject to any disclaimer, the term of this patent is extended or adjusted under 35 U.S.C. 154(b) by 170 days.

(21) Appl. No.: 13/308,633

(22) Filed: Dec. 1, 2011

(65) Prior Publication Data

US 2013/0140870 A1 Jun. 6, 2013

(51) Int. Cl.
*E01C 23/09* (2006.01)

(52) U.S. Cl.
CPC ..... *E01C 23/09* (2013.01)
USPC ..... 404/75; 404/84.05; 404/84.1; 299/1.5

(58) Field of Classification Search
CPC ..... E01C 23/09
USPC ..... 404/84.05–84.5, 94; 299/39.6, 1.5
See application file for complete search history.

(56) References Cited

U.S. PATENT DOCUMENTS

| | | | |
|---|---|---|---|
| 2,574,090 | A | 11/1951 | Dofsen |
| 2,826,128 | A | 3/1958 | Summers |
| 3,094,046 | A | 6/1963 | Zipelius |
| 3,266,846 | A | 8/1966 | Luksch et al. |
| 3,407,006 | A | 10/1968 | Simms et al. |
| 3,529,517 | A | 9/1970 | Murray |
| 3,801,211 | A | 4/1974 | Perkins |
| 3,868,146 | A | 2/1975 | Ellis |
| 3,874,806 | A | 4/1975 | Grist et al. |
| 3,929,377 | A | 12/1975 | Weaver et al. |
| 3,975,055 | A | 8/1976 | Wirtgen |
| 4,270,410 | A | 6/1981 | Herscovici |
| 4,281,560 | A | 8/1981 | Herscovici |
| 4,463,989 | A | 8/1984 | Kennedy |
| 4,575,278 | A | 3/1986 | Whitney |
| 4,640,553 | A | 2/1987 | Zelenka |
| 4,701,069 | A | 10/1987 | Whitney |
| 4,723,867 | A | 2/1988 | Wirtgen |
| 4,725,097 | A | 2/1988 | Zelenka |
| 4,778,304 | A | 10/1988 | Baldi et al. |
| 4,797,025 | A | 1/1989 | Kennedy |
| 4,834,462 | A | 5/1989 | Yamashita |

(Continued)

FOREIGN PATENT DOCUMENTS

| | | | |
|---|---|---|---|
| DE | 2209743 | A1 | 9/1973 |
| DE | 3200862 | A1 | 7/1983 |

*Primary Examiner* — Raymond W Addie
(74) *Attorney, Agent, or Firm* — McNees Wallace & Nurick LLC

(57) ABSTRACT

A system for controlling a cutting machine for cutting rumble strips in a road surface includes a rotatable cutting head, a cylinder for driving the cutting head out of and into contact with the road surface, and a controller. The controller is programmed to execute an input/output function for varying a proportional gain and an error amplification signal over a range of forward speed of the cutting machine. An I/O function is based on six predetermined cutting machine speed values; wherein a proportional gain and a depth increment are specified for each speed value. The respective speed values increase progressively. As an actual forward speed of the cutting machine varies between two of the six predetermined input speed values a linear interpolation is applied between the next lower and the next greater speed value to vary the instantaneous proportional gain and depth increment to be applied by the controller.

20 Claims, 5 Drawing Sheets

(56) References Cited

U.S. PATENT DOCUMENTS

| | | | | |
|---|---|---|---|---|
| 4,852,946 | A | 8/1989 | Hackmach | |
| 4,854,769 | A | 8/1989 | Fukukawa et al. | |
| 4,854,770 | A | 8/1989 | Puchala et al. | |
| 4,878,713 | A | 11/1989 | Zanetis | |
| 4,896,995 | A | 1/1990 | Simmons | |
| 4,900,094 | A | 2/1990 | Sergeant | |
| 4,909,575 | A | 3/1990 | Lupton | |
| 5,046,890 | A | 9/1991 | Dickson | |
| 5,094,565 | A | 3/1992 | Johnson | |
| 5,104,195 | A | 4/1992 | Zaccho | |
| 5,129,755 | A | 7/1992 | Dickson | |
| 5,203,923 | A | 4/1993 | Hartman | |
| 5,215,071 | A | 6/1993 | Mertes et al. | |
| 5,236,278 | A | 8/1993 | Dickson | |
| 5,297,894 | A | 3/1994 | Yenick | |
| 5,378,080 | A | 1/1995 | Dickson | |
| 5,415,495 | A | 5/1995 | Johnson | |
| 5,582,490 | A * | 12/1996 | Murray | 404/90 |
| 6,210,071 | B1 * | 4/2001 | McSharry | 404/94 |
| 6,499,809 | B1 * | 12/2002 | O'Konek | 299/39.6 |
| 6,755,482 | B2 | 6/2004 | Johnson | |
| 7,029,072 | B1 * | 4/2006 | Murray et al. | 299/39.5 |
| 7,029,370 | B2 * | 4/2006 | Cochran et al. | 451/11 |
| 7,837,276 | B2 * | 11/2010 | Kraemer et al. | 299/39.6 |
| 8,025,342 | B2 * | 9/2011 | Kraemer et al. | 299/39.6 |
| 2002/0114420 | A1 * | 8/2002 | O'Leary et al. | 376/202 |
| 2003/0216113 | A1 * | 11/2003 | Maxwell | 451/177 |
| 2004/0005190 | A1 | 1/2004 | Jakits | |

* cited by examiner

CONTROL SYSTEM AND METHOD FOR ROAD CUTTING MACHINE

BACKGROUND

The application generally relates to a control system and method. The application relates more specifically to a system and method for controlling a road cutting machine for cutting a series of depressions along surfaces of roadways.

As motor vehicle operators become fatigued or distracted, the possibility of the vehicle drifting off the road or over the center line and into the opposite lane of traffic increases, either of which can potentially lead to disastrous results. To minimize this occurrence, a series of depressions are cut along the shoulders or center line of the roadway, referred to as ground-in rumble strips. The purpose of the rumble strip is to alert drivers when they have drifted outside their traffic lane by creating a sound and causing vibration to their motor vehicle as its tires travel over the depressions.

In some prior art cutting machines, various methods are employed for engaging and disengaging the cutting drum into the road surface to cut the depression and for repositioning the cutting drum for the next cut. One method of raising and lowering the cutting drum requires an operator to manually control a hydraulic cylinder which is connected to the cutting drum. A problem with this method is that it is difficult for the operator to move the cylinder controls quickly enough to achieve a sufficient production rate (defined as forward feet per minute) while cycling the cutter.

In other prior art cutting machines, electronic controllers may be used to achieve better production rates. For example, U.S. Pat. No. 5,415,495, assigned to the assignee of the present invention, describes an electronic controller responsive to a signal indicative of the forward distance traveled by the cutter. The controller electronically controls an engaging device so that the cutting drum moves out of and into contact with the road surface in accordance with the distance that the cutting drum moves along the road surface and a specified dimensional profile of the depression, which are stored in the electronic controller. Controlling the cutting drum to meet the specified dimensional profile, however, requires further adjustments to the computer controller as the forward speed of the cutting machine increases. The operator must re-program the instruction parameters stored in the computer controller. Such re-programming of the instruction parameters is typically performed by connecting the computer controller to a laptop PC while the machine is idle. The operator is required to stop the machine from cutting in order to change program parameters, and the process for doing so causes a disruption to production and is time consuming.

As an alternative, potentiometers could be provided for the operator to make manual adjustments to the depth and hover parameters, i.e., the depth offset parameter of the cut and the hover offset parameter of the cutting head. Depth and hover offsets are voltage commands (e.g., 0 to 5 volt) that are added to or subtracted from a corresponding depth or hover parameter to adjust for cutting speed or field conditions, e.g., worn teeth on milling bits.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to a system for controlling a cutting machine for cutting rumble strips in a road surface. The system includes a rotatable cutting head, a cylinder for driving the cutting head out of and into contact with the road surface, and a controller. The controller is programmed to execute an input/output function for varying a proportional gain and an error amplification signal over a range of forward speed of the cutting machine. An I/O function is based on six predetermined cutting machine speed input values; wherein a proportional gain and a depth increment, based on the error amplification signal, are specified for each speed input value. The respective speed input values increase progressively. As an actual forward speed of the cutting machine varies between two of the six predetermined input speed values a linear interpolation is applied between the last lower and next greater speed value to vary the instantaneous proportional gain and depth increment to be output by the controller. The hover offset may also be varied by the controller.

Another embodiment relates to a method for cutting rumble strips in a road surface, the method including the steps of specifying a proportional gain and a depth increment for each speed input values for progressively increasing speed input values; executing an input/output function for a controller; basing an I/O function on six predetermined cutting machine speed input values; determining an instantaneous proportional gain and depth increment output value according to a linear interpolation applied between the next lower and the next greater speed value; varying a proportional gain and an error amplification signal over a range of forward speed of the cutting machine; and outputting an instantaneous proportional gain and depth increment from the controller to a control device.

Certain advantages of the embodiments described herein are the ability to automatically and continuously control the dimensional profile of a rumble strip cut into a road surface; and the ability to vary the gain and/or depth increments as the speed of the cutting machine varies.

Alternative exemplary embodiments relate to other features and combinations of features as may be generally recited in the claims.

DETAILED DESCRIPTION OF THE EXEMPLARY EMBODIMENTS

Figure 1:
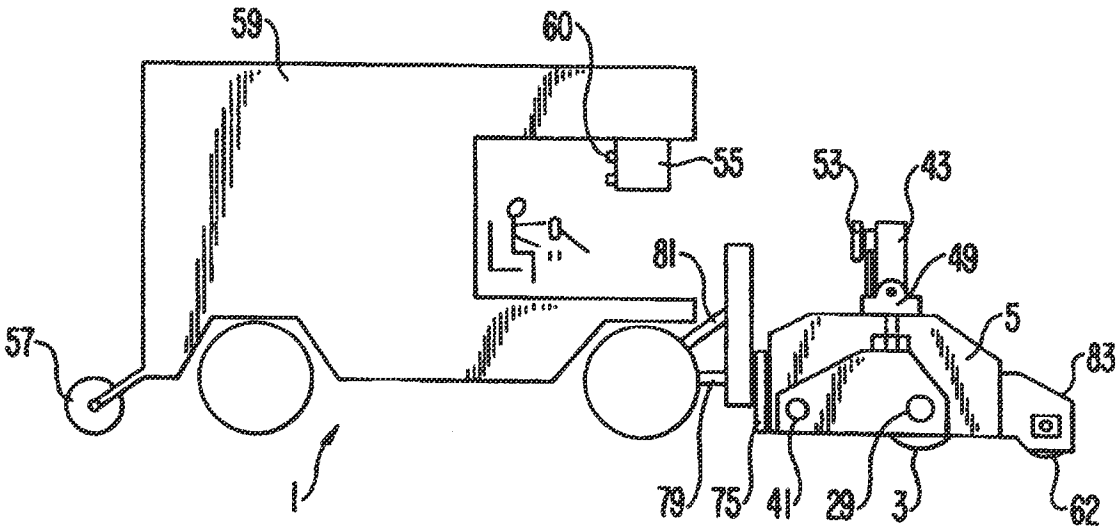
FIG. 1 is an elevational view of a cutting machine.
Figure 2:
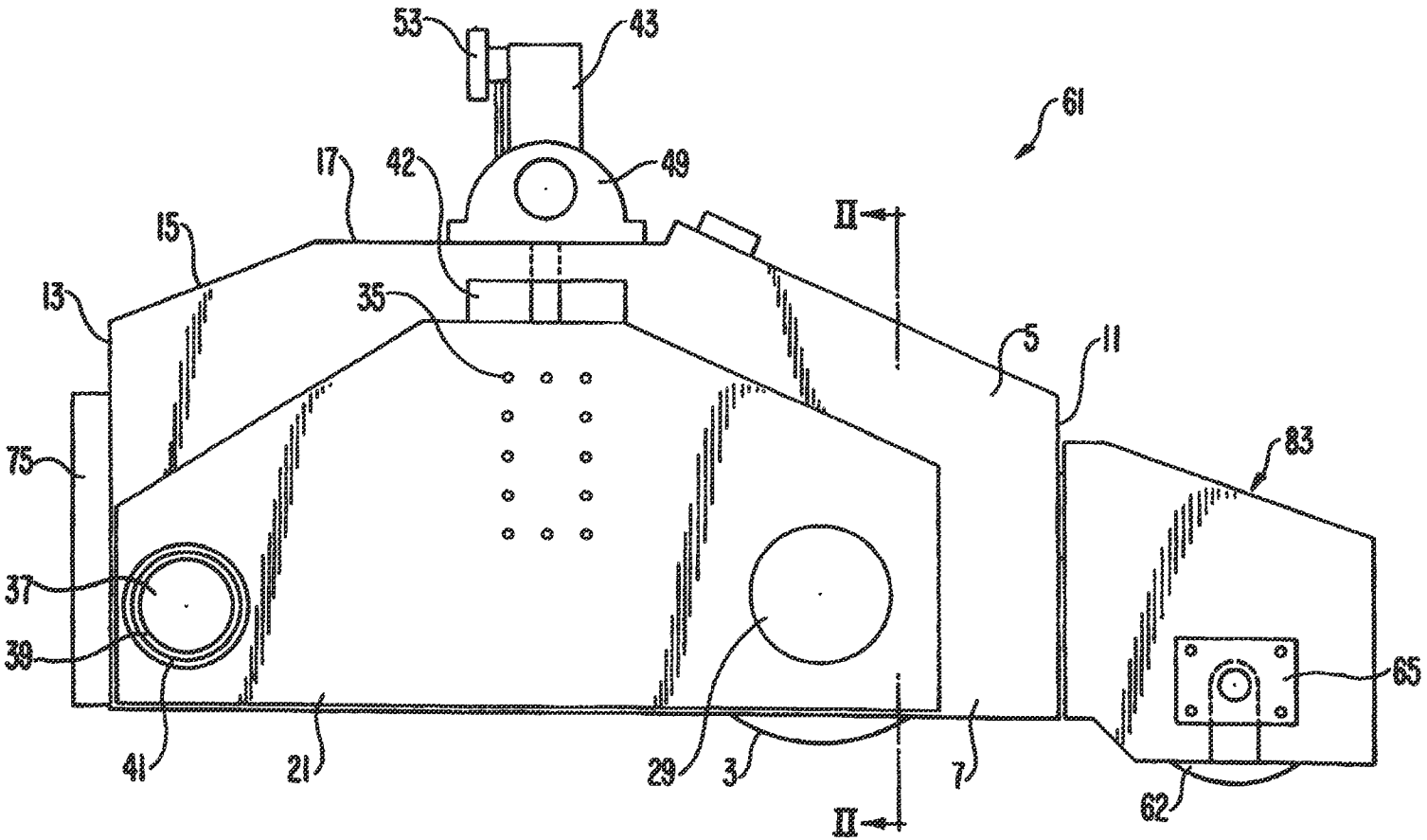
FIG. 2 is an elevational view of the cutting apparatus.
Figure 3:
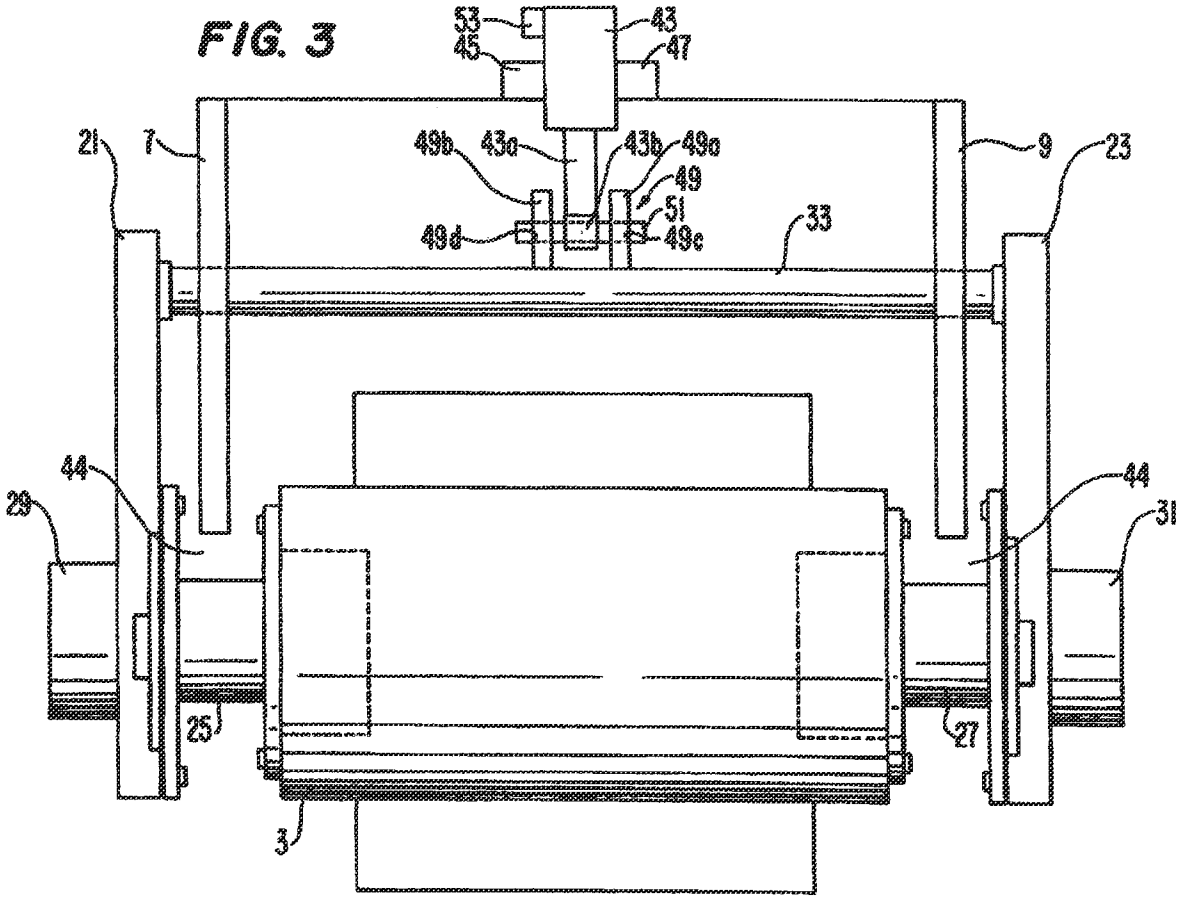
FIG. 3 is a sectional view of the cutting apparatus showing a front view of the cutting head, taken along the lines II-II in FIG. 2.
Figure 4:
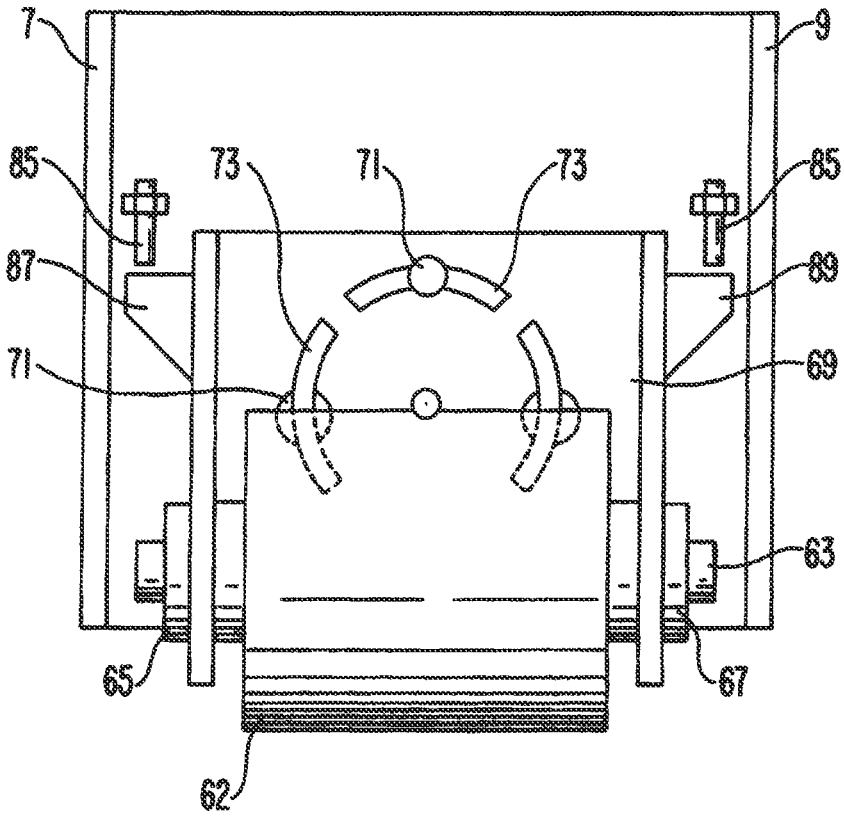
FIG. 4 is a front view of the front roller assembly.

Referring now to the drawings, and particularly to FIGS. 1-3, a cutting machine 1 includes a conventional cutting head/drum 3 contained within a housing weldment 5 having a pair of opposed, substantially parallel, vertically extending side walls 7 and 9. In addition, the housing weldment 5 contains front and rear parallel sidewalls 11 and 13, and two top plates 15, 17 forming part of the top of the housing 5. Access to the inside of the housing 5 from the top is accomplished via a door 19. The bottom of the housing 5 is substantially open.

Referring to FIGS. 2 and 3, the cutting drum 3 is carried within the housing 5 by two arm plates 21 and 23. The cutting drum 3 is attached to each of the arm plates 21 and 23 through respective gear boxes 25 and 27 which contain bearings therein. The gear boxes 25 and 27 are each rigidly attached at one end thereof to the respective arm plate, which allows the opposite end of the gear boxes 25 and 27 to rotate the cutting drum 3. The cutting drum 3 is driven in a conventional manner by two hydraulic motors 29 and 31 which are respectively mounted through the arm plates 21 and 23 and into a respective gear box 25 and 27. The cutting drum 3 is rotated in a counter clockwise/up cut direction relative to a road surface, and uses conventional milling/mining tungsten carbide tipped teeth to cut with. Furthermore, while a hydraulic motor driven system for the cutting heads has been described, other conventional direct or indirect drive systems can be used in lieu thereof, such as a belt driven system.

The arm plates 21, 23 are interconnected at one end by the cutting drum 3 and drive mechanism described above. The arm plates 21, 23 are also interconnected by an I-beam 33 which is connected to each arm plate 21, 23 via bolts 35. The arm plates 21, 23 are also connected at the rear of the housing 5 by a solid shaft 37 which pivots against bearings 39, each of which are contained in a tube 41. The tube 41 is welded to and made part of the housing 5. The combination of the shaft 37, bearings 39 and tube 41 allows the cutting drum 3 and arm plates 21, 23 to pivot up and down. The up and down movement of the cutting drum 3 allows it to be engaged and disengaged with the road surface. Moreover, slots or opening 42 are provided in the side walls 7 and 9 to accommodate the movement of the I-beam 33. Additional slots or openings 44 which extend from the bottom edges of side walls 7, 9 allow for movement of the cutting drum 3 and drive mechanism without interference from the side walls 7, 9.

The cutting mechanism (cutting drum 3, arm plates 21, 23 and gear boxes 25, 27) is raised and lowered by a hydraulic cylinder 43 which is attached to the top plate 17 of the housing 5 by pillow block bearings 45 and 47 and to the I-Beam 33 at an attachment device 49. The attachment device 49 includes two lug portions 49*a*, 49*b* each having a through opening 49*c*, 49*d* therein. The piston 43*a* of hydraulic cylinder 43 has a through opening 43*b* which can be aligned with through openings 49*c*, 49*d*, such that a pin 51 passes through openings 49*c*, 49*d* and 43*b*, thereby connecting the hydraulic cylinder 43 to the cutting mechanism.

Control of the hydraulic cylinder 43 is accomplished via an electronic proportional valve 53. The electronic proportional valve 53 is activated to either raise or lower piston 43*a* of cylinder 43 according to programmed instructions from a computer controller 55. The computer controller 55 is programmed to precisely lower and raise the piston 43*a* to programmed depths as the cutting drum 3 advances across the road surface. The computer controller 55 receives electronic impulses which correspond to the distance traveled by the cutting machine 1 from a conventional wheel mounted encoder 57 which is disposed on the rear of a power unit 59. The power unit 59 can be, e.g., a purpose built custom vehicle that pushes cutting machine 1, or a truck arranged to pull cutting machine 1. Power unit 59 provides utilities such as electricity or hydraulics to the various components of cutting machine 1. Power unit 59 also moves the entire cutting machine 1 along the road surface. Encoder 57 may be an optical encoder or a rotary pulse generator.

Figure 5:
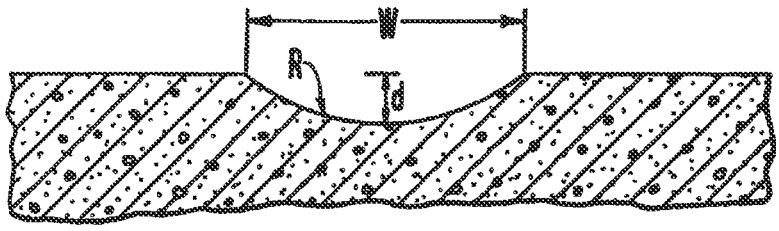
FIG. 5 is a cross-sectional view of a rumble-strip depression cut in a roadway.

As the forward speed of the power unit 59 changes, the rate of electronic impulses being received by the controller 55 from encoder 57, correspondingly changes, so that the distance traveled along the road surface by the cutting machine 1 is continuously calculated by the controller 55 based on the input from encoder 57. The computer controller 55 adjusts the speed at which the piston 43*a* of the cylinder 43 is raised and lowered in order to complete its preprogrammed cycle within the forward distance traveled. This rate of vertical motion directly corresponds to the forward speed of the machine. Thus, referring to FIG. 5, as the cutting drum 3 moves along the width "W" corresponding to the specified width of a depression, the hydraulic piston 43*a* is raised or lowered to obtain the required depression depth "d". Depth "d" may also be specified in accordance with a specified radius of curvature "R".

Preprogrammed instructions pertaining to different cylinder 43 stroke cycles relative to required depression sizing, line spacing and skip or uncut lengths, and patterns may be stored and saved in the computer controller 55. This allows the controller 55 to automatically adjust parameters, e.g., the depth and width of the cuts, according to specifications.

The hydraulic cylinder 43 is a type which contains conventional internal position sensors (not shown) which can provide electronic feedback to the computer controller 55 that is indicative of the position of piston 43*a*. This allows the computer controller 55 to check the actual stroke distance of the cylinder 43 as it travels, and to inform the machine operator by a digital or analog display 60 as to whether or not the cylinder completed its programmed cycle in accordance with the computer controller 55 instructions. Thus, for example, if the power unit 59 is moving too fast such that the cut cannot be completed as required, the operator will be alerted.

Referring now to FIGS. 1 through 4, the mobile power unit 59 pushes or pulls the entire cutting tool apparatus 61 across the road surface. The cutting tool apparatus 61 is supported on a front or rear end thereof by a solid steel roller 62 which is affixed to a shaft 63 which is carried by two bearings 65 and 67. The bearings 65 and 67 are bolted to a roller housing assembly 69 which is firmly attached to the front of the cutter housing 5 by a series of bolts 71 and slots 73 formed in the roller housing assembly 69.

The entire cutting tool apparatus 61 via the housing 5, is attached to a mast 75 of the power unit 59 by a slew type bearing 77 which allows the cutting apparatus 61 to swivel horizontally. The mast 75 is also attached to the power unit 59 by hydraulic cylinders 79 and 81 (two of each, only 1 shown) and control arms (not shown). The height of the rear of the cutting tool apparatus 61 is adjusted by adjusting the mast cylinders 79. Once the height of the rear of the cutting apparatus 61 is adjusted, the lower mast cylinders 79 are pressurized in a manner which continuously tries to retract the bottom of the mast 75 toward the power unit 59. This feature has the affect of transferring the weight of the power unit 59 to the cutting apparatus 61, and thereby continuously forces the front roller 62 into maintaining contact with the road surface.

The weight transfer process discussed above allows for the weight of the power unit 59 to be transferred to the cutter housing 5. As much weight as possible must be applied on the housing 5 in order to ensure that the cutting drum 3 will be driven and held against the road surface during the required cutting cycle by the hydraulic cylinder 43. Sufficient weight is required so that the cutting cycle can be completed without the tool housing lifting up vertically.

The combination of the pressurized cylinders 79, the slew bearing 77 and the front roller assembly 83 enables the cutting tool apparatus 61 to self align with the road surface. As the cutting apparatus 61 is pushed or pulled along the surface of the road, the front roller 62 follows the horizontal plane of the road.

Due to the amount of weight placed on the cutting apparatus 61 due to the cylinders 79, the slew bearing 77 and the front roller assembly 83, the front roller 62 will almost always maintain contact across its width with whatever horizontal road plane it encounters. Since the tool cutting apparatus 61 is able to pivot horizontally about the slew bearing 77, the front roller assembly 83 continuously and automatically forces the cutter housing 5 and cutting drum 3 to be parallel to the road surface. In addition, the tool mast 75 can travel vertically about the cylinders 79 and 81 via a conventional clevis type connection (not shown) that exists between the cylinders 79, 81 and the mast 75. This allows the cutting apparatus to adjust vertically if the cutting drum 3 is forced to move up or down due to a dip or rise in the road surface.

It is desirable that the cutting drum 3 be parallel to the road surface so that as the piston 43*a* of hydraulic cylinder 43 extends, the cutting drum 3 will engage the road surface and extend into the surface evenly across the length of the cut. The above-described leveling feature is self adjusting so that the operation of the cutting machine can meet and maintain a maximum forward speed and a maximum production capability.

An additional feature of the front roller assembly 83 is that it can be re-orientated and locked relative to the cutter housing 5 such that the front roller 62 continues to follow the plane of the road surface, but the front roller assembly 83 will force the orientation of the cutter housing 5 and cutter drum 3 in a manner which is not parallel with the underlying road surface. The manual adjustment of the front roller assembly 83 requires loosening the front roller attachment bolts 71, rotating the front roller assembly 83 as required, and retightening the bolts 71 to relock the front roller assembly 83 to the cutter housing 5. Threaded rods 85 are then adjusted within corresponding threaded receptacles 86 until they abut against stops 87 and 89 to further reinforce the locked position of the front roller assembly 83.

The ability to reposition the front roller assembly 83 is required in the event that the specification for the cut requires the depression be wider and deeper on one side than on an opposite side thereof. By orientating the cutting drum 3 in a non-parallel manner relative to the underlying road surface, the cutting drum 3 is effectively located closer to the surface at one end thereof as compared to the other end. As the cylinder piston 43*a* extends the cutting drum 3 to engage the road surface, the cutting drum 3 is actually extended deeper into the road surface on one side of the cut than on the opposite side of the cut.

In operation, the operator first orientates the power unit 59 and cutting apparatus 61 over the area to be cut. The cutting drum 3 is suspended and held by the tool cylinder 43 at a hover point above the road surface. Then, the cutting drum 3 is generally orientated parallel to the road surface by adjusting the front roller assembly 83. However, as mentioned above, the front roller assembly 83 can be adjusted such that the cutting drum 3 is not parallel to the underlying surface in the event that a specification or road condition requires a cut which is inconsistent across its length. The operator then engages the drive mechanism of the power unit 59 and moves the cutting apparatus 61 forward. As the power unit 59 advances, the encoder 57 instructs the computer controller 55 to begin executing its preprogrammed instructions and provides a signal to the controller 55 which is indicative of the distance traveled along the road surface. The computer controller 55, based on the signal from the encoder 57, sends signals to the proportional valve 53 which controls the movement of the piston 43*a* of tool cylinder 43, such that the cutting drum 3 is vertically moved into and out of contact with the road surface in a precise manner as it moves across the road surface. The movement of the piston 43*a* is set at a rate which is proportional to the forward speed of the power unit. In other words, the encoder continually supplies the computer with a signal indicative of detected forward movement of the power unit 59 and the computer controller 55 adjusts the piston 43*a* in relation to the forward movement such that the specified depression cut size is obtained.

The operator steers the power unit 59 to maintain the alignment of the cuts and monitors the computer to ensure that the program cycles are being completed. The operator further controls the operation by adjusting the maximum forward speed and production rate of the cutting machine 1 according to such things as road surface density or hardness. For example, if the road surface is easier to cut because it is soft, the operator will advance the power unit 59 forward at a faster rate in order to increase production. Moreover, due to the self-aligning features of the tool housing 5, the housing 5 will continuously self-adjust itself both horizontally and vertically to the road surface which allows the operator to proceed without stopping to make adjustments to the housing orientation. The resulting pattern left by the cutting apparatus 61 is a series of rumble strip depressions which are typically spaced twelve inches on center.

The controller 55 may be implemented using a microcontroller. The microcontroller display 60 system may be interfaced with a control panel in cutting machine 1 which may also include switches, potentiometers, encoder, head height sensor and an output for valve commands.

Controller 55 controls cutter head movement, i.e., into and out of a road surface. Cutter head movement varies dependent upon the speed of the cutting machine 1. Controller 55 is programmed to include continuously variable proportional gain and error amplification throughout the entire speed range. Operator input is not required when cutting machine 1 speed changes. Error amplification increases the speed at which cutting drum 3 advances and retracts into and out of the road surface. Further, error amplification maintains the speed of cutting drum 3 proportional to the forward speed of cutting machine 1. Error amplification is accomplished by adding additional depth to the requested depth depending on the speed of the cutting machine 1, which results in a higher output to the valve controlling the speed of the cutter head movement. The additional depth, or depth increment, is dependent on cutting machine forward speed. The proportional gain and error amplification are adjusted automatically over the forward speed range of cutting machine 1. Controller 55 may also be programmed to recalibrate based on fine differences in depth of the cut, such as that which may occur due to cutting teeth wear.

Figure 6:
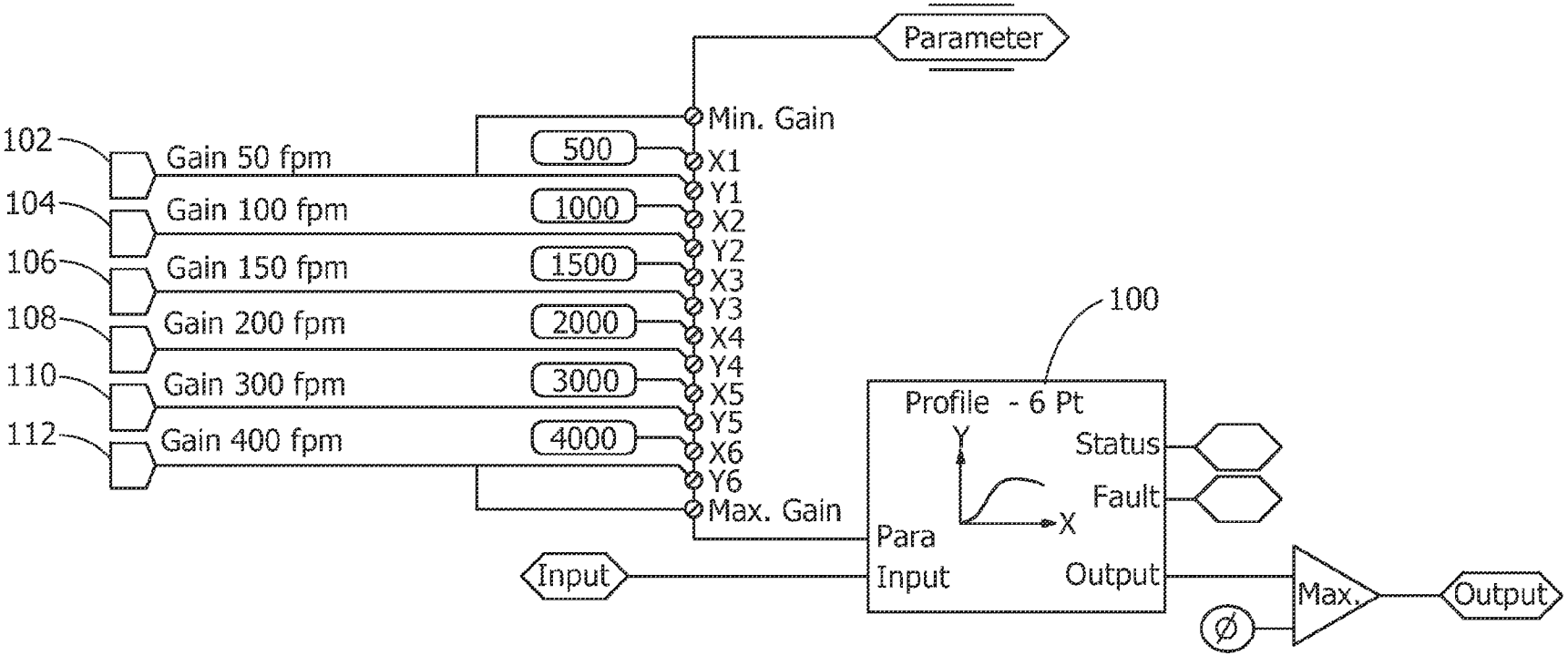
FIG. 6 is a schematic diagram of the I/O points and control profile for the cutting machine controller.

Referring to FIG. 6, in an exemplary embodiment controller 55 may apply a six point profile or function 100 for varying proportional gain and error amplification over a range of forward speed of cutting machine 1. As shown in FIG. 6, the six point profile 100 defines the input/output function, wherein the input parameter is along the x-axis, corresponding to cutting machine speed, and the output signal is represented along the y-axis, corresponding to proportional gain. The gain and error amplification signals each are implemented in the controller 55 in the same manner. FIG. 6 shows the gain signal algorithm. The error amplification algorithm works in the same way so will not be described in detail. At each of six different, predetermined cutting machine speeds, a proportional gain and a depth increment are specified. At a first gain input point 102 representing a first cutting machine speed of 50 fpm, a gain (Y1) is assigned to the output value. At a second speed input point 104, representing a second cutting machine forward speed of 100 fpm, a gain (Y2) is assigned. The gain values will increase from (Y1) to (Y6) to increase the speed of the cutting head with increasing cutting machine speed. In this example, any speed below 100 fpm will have a gain of (Y1), as denoted by the Min Gain setting attached to speed input point 102. Similarly, for a third speed input point 106, a fourth speed input point 108, fifth speed input point 110 and a sixth speed input point 112, a gain (Y3, Y4, Y5 and Y6) is assigned to the output value. Proportional Gain (P-Gain) values are unit-less quantities represented along the y-axis. P-Gain variables may be tuned, e.g., by an operator to the particular cutting machine 1. Different cutting machines 1 may be tuned for different (P-Gain) values due to variations in mechanical properties or hydraulic system components of the machines, for example.

Parameter values for X increase from X1 through X6, i.e., X1<X2<X3<X4<X5<X6 which represents the six chosen speeds. The parameter values for X1 . . . X6 can be any values, provided X1<X2<X3<X4<X5<X6. This property provides flexibility in shaping the output curve as well as making the system adaptable, e.g., for higher machine speeds in the future. As the forward speed of cutting machine 1 advances between two of the six predetermined input speed points X1-X6, a linear interpolation is used to approximate a desired forward speed profile, from which controller 55 computes the respective proportional gain and depth increment based on the current forward speed. Output gain parameters for Y axis of profile 100 may increase, decrease or be equal between corresponding Y axis points Y1 through Y6. For forward speed ranges greater than the highest specified speed (X6), the proportional gain and depth increment parameters are limited to the value (Y6) attached to Max Gain. Alternately, outputs for speed above and below the predetermined speed ranges for X1 to X6 may be extrapolated from the next two adjacent points (Y1 and Y2, or Y5 and Y6) for the low and high forward speed values, respectively.

In an alternate embodiment, the six predetermined forward speed points may be defined at increments of 50 f/min, beginning at 50 f/min for the first speed point, until the forward speed reaches, and then 100 f/min increments thereafter. For example, the remaining predetermined speed points are then set at 100, 150, 200, 300 and 400 f/min, respectively.

In yet another alternate embodiment, more or less forward speed points may be defined over the desired range of forward speed of cutting machine 1. E.g., forward speed increments may be set at 100 f/min., to vary the rate that the proportional gain and depth increment change every 100 f/min increment of speed. As indicated above, the predetermined speed points can be any values, as long as X1<X2<X3, etc. The rate of change of the proportional gain and depth increment values may be varied according to a virtually continuous input/output (I/O) curve as illustrated in FIG. 6. The I/O profile 100 of the forward speed vs. proportional gain/depth increment adjustment may be loaded as software into microcontroller 55 prior to a road surface cutting operation. Alternately, profile 100 may be implemented in hardware or programmable devices.

Cutting machine 1 and controller may be configured to accumulate and store statistical data related to the use and life of the cutting machine. When controller 55 is programmed to operate cutting machine 1 under the six point model defined above, the controller 55 may automatically calculate and store a distance that cutting machine 1 travels from the start of a cutting cycle, and the stored distance value is viewable on display 60 in the operator cabin. The controller 55 distance calculation automatically ignores distance covered when the cutting operations are paused—i.e., the cutting head is raised above the surface. Thus, the cutting machine operator is not required to manually throw a switch to disable a summation type counter as was previously the case, thereby eliminating human error in automatically calculating the distance. Distance data may be used for various purposes, e.g., for billing purposes where distance is the basis for determining the contract price, or in estimating wear and tear on a cutting machine for maintenance purposes. The distance value is resettable to zero from the display 60. If not reset to zero, the distance value remains unchanged after cycling power off and on.

For maintenance and servicing, controller 55 also calculates and stores a cumulative distance value while cutting the rumble strips. Controller 55 automatically ignores distance covered when the cutting operations are paused. Cumulative distance data is available when a personal computer (PC) with the appropriate software is connected to the control system. The cumulative distance value is resettable to zero by using said PC and software, e.g., when the maintenance is performed at a predetermined service interval. Cumulative distance data may be used, e.g., to track cutting machine distance since the last service was performed, for preventative maintenance.

The cutting machine also calculates and stores a "lifetime" distance accumulator via controller 55. The lifetime distance value tracks the lifetime cumulative distance of cutting machine 1 that is travelled while cutting rumble strips. Controller automatically ignores distance covered when the cutting operations are not enabled in automatic mode. This data is available when a PC with the appropriate software is connected to the control system. Lifetime cumulative distance travelled value is resettable by using an authorized PC and software. Lifetime cumulative distance travelled data tracks cutting machine distance over its operating life.

Controller 55 may be also configured to calculate the depth of a rumble strip. The depth of a rumble strip may be calculated by capturing the maximum signal from internal position sensors inside hydraulic cylinder 43 and comparing the calculated depth with the calibrated value for ground level for each rumble strip produced. An average depth value is computed by controller 55 from several consecutive depth values, and the average depth value displayed on display 60. The average depth value provides an approximate indication of the depth of the rumble strip, depending on the accuracy of the calibrated ground level as well as changes in slope of the roadway. The average depth value calculation avoids the need for the current normal manual measurements obtained by additional personnel in a chase cutting machine 1.

Controller 55 may be equipped with tuning capability for checking the valve movement and adjustment of cutting head 3 movement into and out of the road surface at various speeds. Tuning may be accomplished via several trial and error procedures where the head is moved up and down without having to contact the road surface or having to move the cutting machine 1. In a warm up mode, a cutting machine speed is set in controller 55 to simulate cutting machine travel. Any speed can be simulated, and cutting head 3 responds as if cutting machine 1 is in motion at the simulated speed. In operation, cylinders heat the hydraulic oil, which is initially cold and may have different viscosity which may in turn affect tuning of the machine without a warm up cycle. Thus, the proportional gains and depth increments at each of the six predetermined speed points described above may be tested and optimized to produce required depth of cut.

Further accuracy in tuning may be obtained by identification of a calculable parameter, i.e., a backcut. The backcut is defined as a distance that the cutting head cuts behind (relative to cutting machine 1 motion) its initial contact with the road surface. The combination of proportional gain and depth increment should produce a calculated backcut in the range of 0.6-1.4 inches, for example. The backcut values dependent on the required dimensions of the rumble strip depression as well as the type and hardness of material being cut. The stroke or total vertical distance travelled to complete one cycle is another parameter which varies with cut dimensions. The gain and depth increments may be varied to produce an optimum depth, backcut, and stroke required for the conditions at each of the six predetermined speed points described above.

Controller 55 may also be configured to limit the machine speed that at which it will cut rumble strips. Controller 55 monitors the cutting machine 1 speed and if it is higher than the limit, the machine's normal cutting operations are suspended until the machine is slowed to below the limit. The speed limit can be modified when a PC with the appropriate software is connected to the controller 55. The speed limit control is settable using said PC and software. If the speed limit is set to zero, the speed limit control is disabled and the machine will operate at any speed. Alternatively, controller 55 may record the number of times and distance that cutting machine travels above the speed limit, and flash a warning on the display 60. The speed limit function may be used, e.g., to ensure warranty conditions are met in the case of a sale or lease of a cutting machine to a third party.

A method for cutting rumble strips in a road surface is described in a flow chart. The method begins at step 200, by specifying a proportional gain and a depth increment for each speed input values for progressively increasing speed input values. Next, the method proceeds to step 210, and executes an input/output function for a controller. At step 220, the method provides an I/O function based on six predetermined cutting machine speed input values. Next, at step 230, the method proceeds by determining an instantaneous proportional gain and depth increment output value according to a linear interpolation applied between the next lower and the next greater speed values. At step 240, the method varies a proportional gain and an error amplification signal over a range of forward speed of the cutting machine. Finally, at step 250, the method continues by outputting an instantaneous proportional gain and depth increment from the controller to a control device for cutting rumble strips. The method continues iteratively during operation of cutting machine 1.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

It is important to note that the construction and arrangement of the cutting machine control apparatus and method as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

As noted above, embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. A system for controlling a cutting machine for cutting rumble strips in a road surface, the system comprising a rotatable cutting head, a cylinder for driving the cutting head out of and into contact with the road surface, and a controller; wherein the improvement comprises:

the controller programmed to vary a proportional gain and an error amplification signal over a range of forward speed of the cutting machine, wherein the varying proportional gain increases and decreases the speed of the cutting head proportionally with the forward speed of cutting machine.

2. The system of claim 1, further comprising the controller programmed to execute an input/output function based on a plurality of predetermined cutting machine speed values to vary the proportional gain and error amplification signal to be applied by the controller.

3. The system of claim 1, wherein a proportional gain and a depth increment are specified for each speed value of the plurality of speed values.

4. The system of claim 3, wherein a forward speed of the cutting machine varies between two of the predetermined input speed values.

5. The system of claim 4, wherein a linear interpolation is applied by the controller to interpolate a proportional gain and a depth increment for a speed value falling between the next lower and the next greater speed value.

6. The system of claim 1, wherein the speed values increase progressively.

7. The system of claim 1, wherein the controller varies the proportional gain and a depth increment by executing an input/output function.

8. The system of claim 1, wherein the controller is further programmed to accumulate and store statistical data related to the use and life of the cutting machine.

9. The system of claim 1, wherein the controller is further programmed to calculate and store a cumulative distance travelled by the cutting machine and a number of cuts made while cutting rumble strips and while the cutting machine is operating in an automatic mode.

10. The system of claim 1, wherein the controller is further programmed to calculate and stores a lifetime accumulated distance travelled by the cutting machine.

11. The system of claim 1, wherein the controller is further programmed to calculate the depth of a rumble strip.

12. The system of claim 1, wherein the controller is further programmed to calculate the stroke of a cylinder.

13. The system of claim 1, wherein the controller is further programmed to recalibrate based on cutting teeth wear.

14. The system of claim 1, wherein the plurality of predetermined cutting machine speed values comprises six predetermined cutting machine speed values.

15. A method for cutting rumble strips in a road surface, comprising:

specifying a proportional gain and a depth increment for each speed input values for progressively increasing speed input values;

executing an input/output function for a controller; basing an I/O function on six predetermined cutting machine speed input values;

determining an instantaneous proportional gain and depth increment output value according to a linear interpolation applied between the next lower and the next greater speed value;

varying a proportional gain and an error amplification signal over a range of forward speed of the cutting machine;

increasing or decreasing the speed of the cutting head proportionally with the forward speed of cutting machine in response to varying the proportional gain;

wherein the error amplification signal includes automatically adding an artificial depth to the actual desired depth of the cut in response to a speed signal from the controller, to increase the voltage signal to the valve automatically; and outputting an instantaneous proportional gain and depth increment from the controller to a control device.

16. The method of claim 15, further comprising the step of calculating a depth of a rumble strip cut.

17. The method of claim 16, wherein the step of the step of calculating a depth of a rumble strip cut further comprises:

capturing a maximum signal from an internal position sensor inside of a hydraulic cylinder; and comparing the calculated depth with a calibrated value for ground level for each rumble strip cut.

18. The method of claim 17, further comprising the step computing an average depth value from a plurality of consecutive depth values.

19. The method of claim 18, further comprising the step of displaying the average depth value.

20. A system for controlling a cutting machine for cutting a road surface comprising:

a rotatable cutting head, a cylinder for driving the cutting head out of and into contact with the road surface, and a controller programmed to execute an input/output function based on a plurality of predetermined cutting machine speed values to vary a proportional gain signal and a depth increment signal to be applied by the controller to operate the cylinder;

wherein the varying proportional gain increases and decreases the speed of the cutting head proportionally with the forward speed of cutting machine; and wherein the error amplification signal includes automatically adding an artificial depth to the actual desired depth of the cut in response to a speed signal from the controller, to increase the voltage signal to the valve automatically.

* * * * *